United States Patent [19]

Barca

[11] Patent Number: 4,664,012

[45] Date of Patent: May 12, 1987

[54] BASS DRUM PEDAL ASSEMBLY

[76] Inventor: Alan L. Barca, 1120 Eighth Ave., Addison, Ill. 60101

[21] Appl. No.: 865,774

[22] Filed: May 22, 1986

[51] Int. Cl.[4] ..... G10D 13/08

[52] U.S. Cl. ..... 84/422 R

[58] Field of Search ..... 84/422

[56] References Cited

U.S. PATENT DOCUMENTS

| | | | |
|---|---|---|---|
| 590,182 | 9/1897 | Bower | 84/422 R |
| 846,391 | 3/1907 | Bower | 84/422 R |
| 1,508,390 | 9/1924 | Gladstone | 84/422 R |
| 2,800,828 | 7/1957 | Moeller | 84/422 R |
| 3,563,129 | 2/1971 | Coatrell | 84/422 R |
| 3,618,441 | 11/1971 | Fearns | 84/422 R |
| 3,994,197 | 11/1976 | Bills | 84/422 R |
| 4,134,325 | 1/1979 | Loftus | 84/422 R |
| 4,262,576 | 4/1981 | Gorsky | 84/422 R |
| 4,315,453 | 2/1982 | Gabor | 84/422 R |

*Primary Examiner*—Lawrence R. Franklin

*Attorney, Agent, or Firm*—Miller, Morriss & Pappas

[57] ABSTRACT

A bass drum pedal assembly consisting of a floor engaging support base adapted for selective operative engagement to an adjacent drum beater assembly. A cradle pedal support frame is pivotally mounted on the support base in substantially movable register with and above thereof. The pedal support frame is adapted at the forward free end thereof to operatively engage an actuator strap of an adjacent drum beater assembly. A foot engaging flexible cradle pedal assembly is transversely freely swivellably mounted on the cradle pedal support frame so as to selectively engage the ball of a drummer's foot in self-adjusting contact therewith. The flexible cradle pedal assembly is selectively longitudinally and vertically adjustable when mounted in its operative use position on the cradle pedal support frame. The cradle support frame is adapted to selectively actuate a drum beater assembly when connected to the actuator strap thereof in response to foot pressure selectively exerted upon the flexible cradle pedal assembly.

5 Claims, 7 Drawing Figures

BASS DRUM PEDAL ASSEMBLY

This invention relates to a bass drum pedal assembly comprising a floor engaging support base adapted for selective operative engagement to an adjacent drum beater assembly. A cradle pedal support frame is pivotally mounted on the support base in substantially movable register with and above thereof. The cradle pedal support frame is adapted at the forward free end thereof to operatively engage an actuator strap of an adjacent drum beater assembly. The support base and the cradle pedal support frame mounted thereon are open-ended rearwardly so as to provide free access to the drummer's foot. A foot engaging flexible cradle pedal assembly is transversely freely swivellably mounted on the cradle pedal support frame so as to selectively engage the ball of a drummer's foot in self-adjusting contact therewith. The use of the flexible cradle pedal assembly provides a more responsive and controlled pedal action. The flexible cradle pedal assembly is selectively longitudinally and vertically adjustable when mounted in its operative use position on the cradle pedal support frame so as to accommodate various playing styles and personal needs of individual drummers. Thus, the cradle pedal support frame is adapted to selectively actuate a drum beater assembly in response to foot pressure selectively exerted by a drummer upon the flexible cradle pedal assembly.

None of the devices of the prior known art teach or otherwise anticipate the use of a swivelly mounted flexible cradle pedal support member which is adapted to operatively engage the ball of the drummer's foot so as to provide a more responsive and controlled pedal action such as is provided by the applicant's invention. The structures of the prior art generally are comprised of rigid pedal elements which are adapted to engage the entire foot of the drummer and therefor lack the capability of the sensitive foot engagement provided by the instant invention.

A need has existed for a bass drum pedal assembly which is provided with a swivellably mounted flexible cradle pedal member which only engages the ball of the drummer's foot so as to provide a more responsive, controlled and free pedal action.

A further need has existed for a bass drum pedal assembly which is open-ended rearwardly so as to provide free access of the drummer's foot.

A further need has existed for a bass drum pedal assembly having a flexible cradle pedal assembly which replaces the conventional bass drum pedal which covers the foot from heel to toe.

Yet another need has existed for a bass drum pedal assembly having a flexible cradle pedal assembly which provides operative engagement solely with the ball of a drummer's foot so as to provide a more responsive and controlled pedal action than is provided by the rigid pedal structures utilized by the bass drum pedal assemblies of the prior known art.

A still further need has existed for a bass drum pedal assembly having a swivelly mounted flexible cradle pedal strap which is selectively adjustable vertically and/or longitudinally along the pivotally mounted cradle pedal support frame so as to provide selective universally adjustability to engage the foot of an individual drummer so as to accommodate individual playing styles and personal needs of each drummer.

Another need has existed for a bass drum pedal assembly having a swivelly mounted flexible cradle pedal strap which maintains maximum surface contact in the crucial ball area of the drummer's foot.

It is therefore an object of this invention to provide a unique bass drum pedal assembly having a swivellably freely mounted flexible cradle pedal strap member which selectively engages the ball of a drummer's foot so as to provide a more responsive and controlled pedal action hitherto not found in the devices of the prior known art.

Other objects and advantages found in the construction of the invention will be apparent from a consideration of the following specification in connection with the appended claims and the accompanying drawings.

DESCRIPTION

Figure 1:
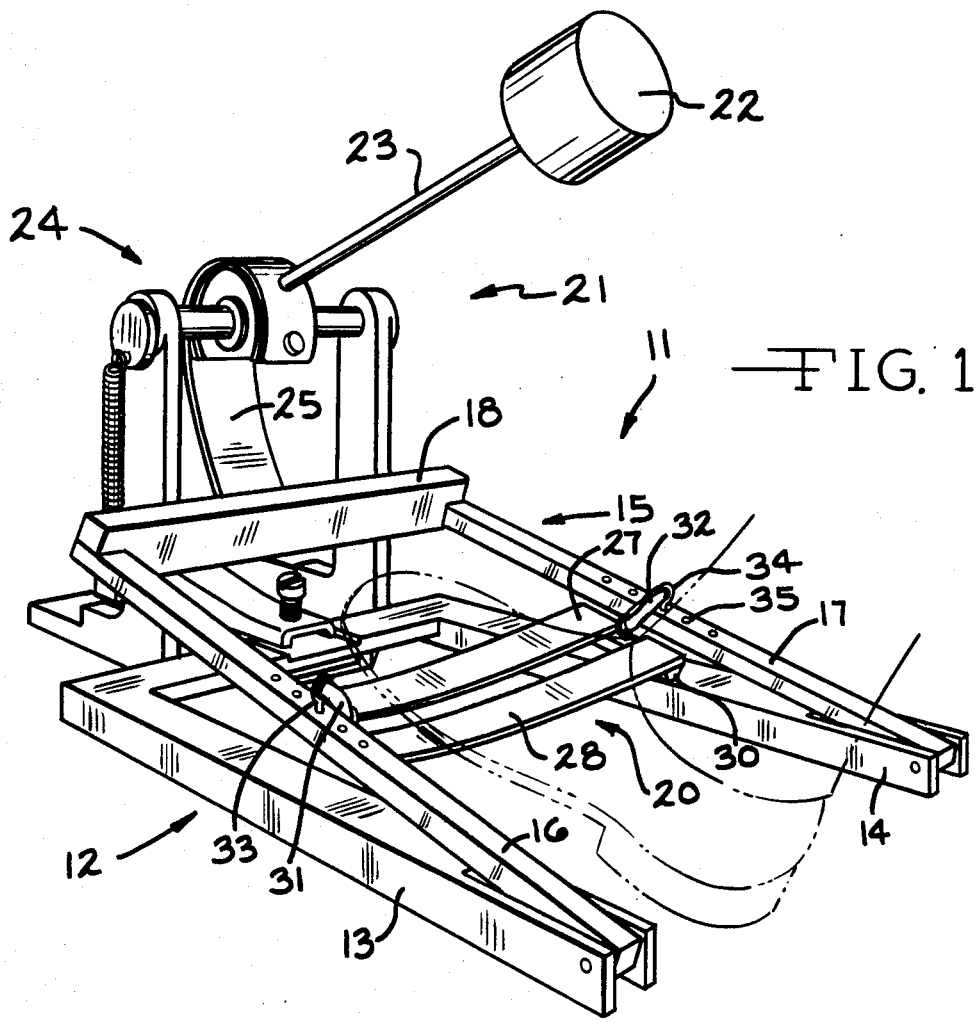
FIG. 1 is a perspective view of the bass drum pedal assembly showing the swivellably mounted flexible cradle pedal strap member transversely provided on the pivotally mounted cradle pedal support frame and showing the rearwardly open-ended configuration of the bass drum pedal assembly.

As shown generally in the drawings and more specifically in FIG. 1 thereof, the bass drum pedal assembly 11 comprises a substantially U-shaped floor-engaging base support member 12, which is provided with longitudinal rearwardly extending legs 13 and 14 and which is open-ended at the rear thereof. It is considered to be within the scope of the invention to utilize a convenient type of support base which is rearwardly open-ended.

A substantially U-shaped cradle pedal support frame 15 is provided which comprises a pair of longitudinal cradle pedal support legs 16 and 17, respectively, which are connected to a transverse connector leg 18 having a centrally located extention 19 which is adapted to selectively engage a drum beater assembly actuator strap.

Figure 2:
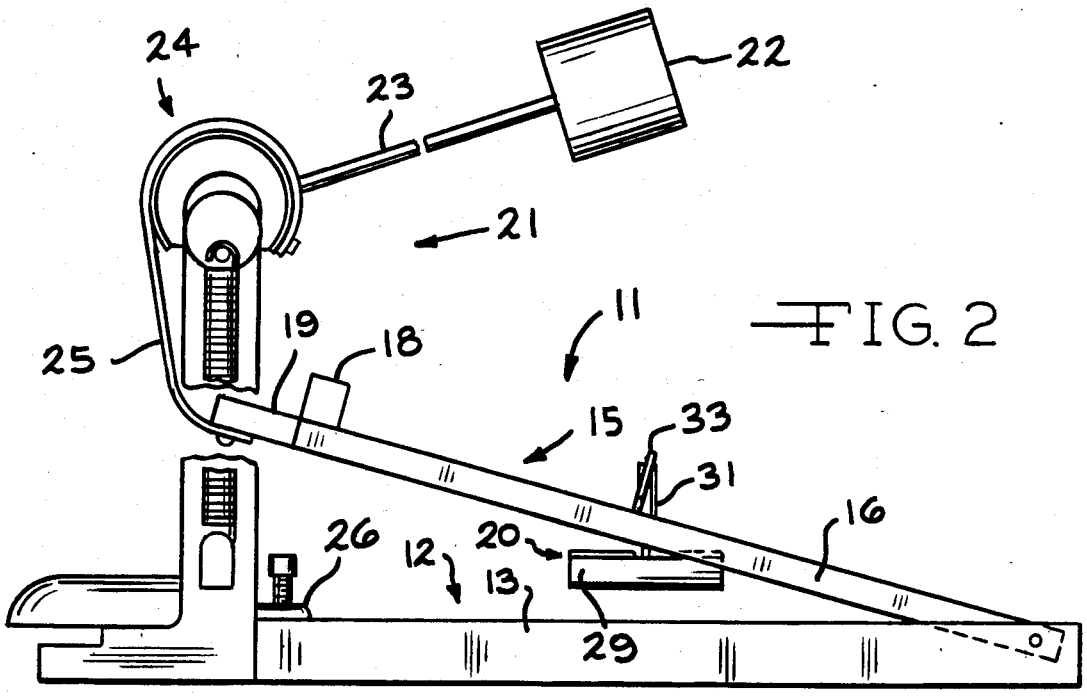
FIG. 2 is a side elevational view thereof showing the bass drum pedal assembly in operative engagement with an adjacent drum beater assembly.

As shown in FIGS. 1 and 2, the cradle pedal support frame 15 is pivotally connected to the base support member 12. Thus positioned, the cradle pedal support frame 15 is in substantial register with and located above the base support member 12.

As shown in FIGS. 1 and 2, a foot-engaging flexible cradle pedal member 20 is swivellably suspended transversely between the longitudinal cradle pedal support legs 16 and 17, respectively. Thus positioned, the foot-engaging flexible cradle pedal member 20 is freely suspended from the longitudinal cradle pedal support legs 16 and 17 of the cradle pedal support frame 15.

As further shown in FIGS. 1 and 2, the bass drum pedal assembly 11 is shown in its operative use position in engagement with a standard drum beater assembly 21. The drum beater assembly 21 is well known in the art and consists of a beater 22 positioned on a beater arm 23 which is selectively movable in an arcuate path so that the beater 22 selectively beats against the surface of an adjacent drum. The beater arm 23 is fixedly attached to a spring-biased rotatable collar assembly 24 which is provided with a downwardly actuator strap member 25.

As shown in FIG. 2, the actuator strap member 25 is selectively attached to extension 19 of the transverse connector leg 18 of the cradle pedal support frame 15. It is within the scope of the invention that the actuator strap 25 can be directly attached to the transverse connector leg 18.

As shown in FIGS. 1 and 2, the U-shaped base support member 12 is clampably anchored to the base of the drum beater assembly 21 by use of an anchor leg 26. However, it is considered to be within the scope of the invention that any type of connecting means be utilized depending on the type of drum beater assembly that is utilized among the many of the drum beater assemblies that are well known in the prior art. Thus attached to a standard drum beater assembly 21, the bass drum pedal assembly 11 of the instant invention is ready for use by a drummer.

In use, the drummer positions his foot in the open end of the base support member 12 so that the ball of the foot is in direct contact with and is supported by the transverse flexible cradle pedal 20. The heel of the drummer's foot is generally in direct contact with the floor but that is not necessary. The drummer may position his foot as desired so as to most effectively utilize the foot-cradle pedal contact to achieve the desired drum effect. The relative positioning of the foot with respect to the bass drum pedal assembly 11 and the flexible cradle pedal 20 is shown in phantom line in FIG. 1 and in FIG. 7.

In "playing" the drum, the drummer presses his foot downwardly against the upper surface of the cradle pedal 20 causing the cradle pedal support frame 15 to pull downwardly on the actuator strap member 25 of the standard drum beater assembly so that the beater 22 strikes the surface of an adjacent drum as desired.

Figure 3:
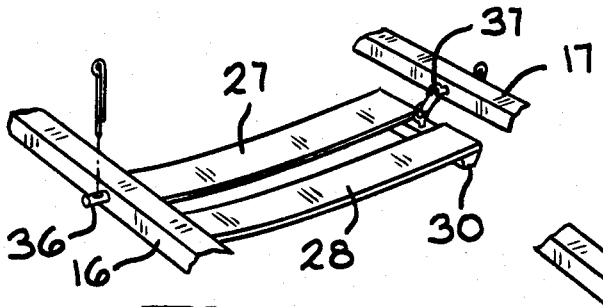
FIG. 3 is a partial schematic perspective view of the swivellably mounted flexible cradle pedal strap member showing a dual parallel spaced apart strap embodiment thereof.

As shown in FIGS. 1 and 3, the cradle pedal strap assembly 20 comprises a pair of transverse parallel spaced apart flexible straps 27 and 28 which are mounted on spaced apart longitudinally oriented cradle support bars 29 and 30.

The cradle support bars 29 and 30 are swivellably freely suspended from the longitudinal cradle pedal support legs 16 and 17 by use of flexible and adjustable connectors 31 and 32 attached to anchor pegs 33 and 34, respectively. Thus, by selectively shortening or lengthening the connectors 31 and 32 and/or the anchor pegs 33 and 34, the cradle pedal assembly 20 can be vertically raised and/or lowered in relation to the floor surface. Further, this vertical adjustment capability can be also accomplished by many other similar mechanical means.

The anchor pegs 33 and 34 are adapted to selectively engage adjustment holes 35 which are provided along the longitudinal pedal support legs 16 and 17. The drummer can selectively adjust the longitudinal location of the cradle pedal assembly 20 to accommodate his particular drumming style and needs by selectively moving the pegs 33 and 34 forward or rearward by use of the adjustment holes 35. This selective vertical and longitudinal adjustment capability enables the drummer to personalize the bass drum pedal assembly 11 to meet his particular foot size, drumming style and needs.

An alternate method of connecting the cradle pedal member 20 to the longitudinal legs 16 and 17 is shown in FIG. 3 whereby horizontally oriented pegs 36 and 37 are utilized to selectively engage the legs 16 and 17, respectively.

Figure 4:
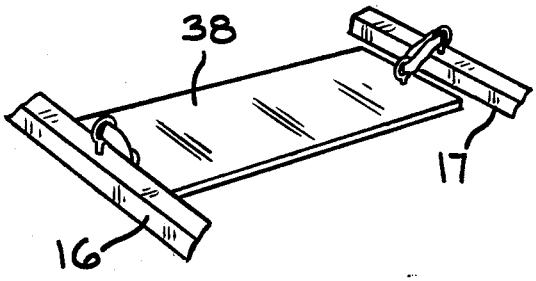
FIG. 4 is a partial schematic perspective view of the swivellably mounted flexible cradle strap member showing a single strap embodiment thereof.

Another embodiment of the cradle pedal assembly 20 is shown in FIG. 4 which comprises a single flexible strap member 38 freely transversely suspended between the legs 16 and 17.

Figure 5:
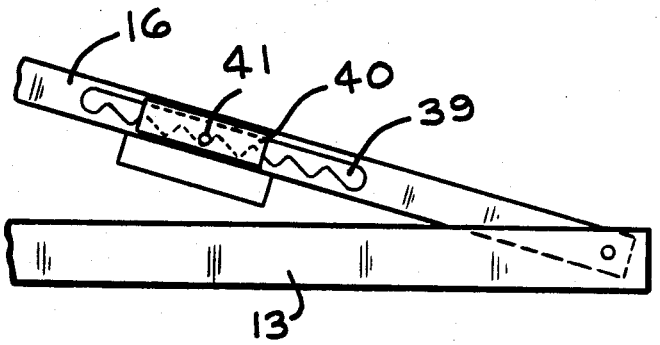
FIG. 5 is a side elevational view of another embodiment of the bass drum pedal assembly showing the cradle pedal member longitudinal adjustment slot means provided in the cradle pedal support frame structure.

Another embodiment of the cradle pedal assembly is shown in the partial schematic view of FIG. 5 whereby each cradle pedal support leg 16 and 17 is provided with a toothed adjustment slot 39. A slidable adjustment bar 40 having a tooth-engaging transverse bar 41 is provided in each slot 39 provided on each support leg 16 and 17. The cradle pedal assembly 20 is freely suspended from each adjustment bar 40 so as to enable the drummer to quickly and easily selectively adjust the longitudinal location of the transverse cradle pedal assembly 20 between the cradle pedal support legs 16 and 17 in accordance with his particular needs.

Figure 6:
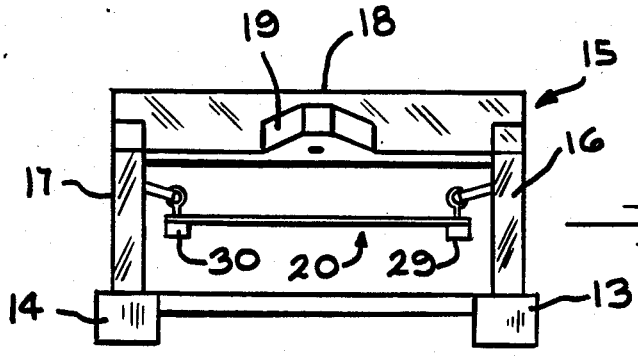
FIG. 6 is a front elevational view of the bass drum pedal assembly.

A front elevational view of the bass drum pedal assembly 11 is shown in FIG. 6 which shows the cradle pedal assembly 20 freely suspended from the legs 16 and 17 of the cradle pedal support frame 15.

Figure 7:
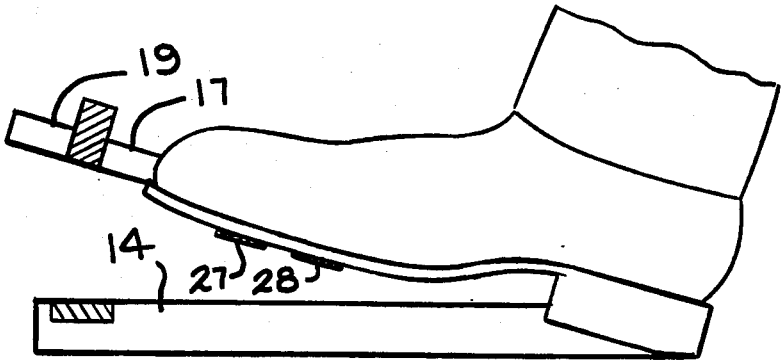
FIG. 7 is a side sectional schematic view showing the foot of the drummer in operative engagement with the flexible cradle pedal.

The partial schematic view of FIG. 7 shows the foot of the drummer in operative engagement with the flexible straps 27 and 28 of the cradle pedal assembly 20.

It is thus seen that a highly utilitarian bass drum pedal assembly is provided by use of the cradle pedal which increases the response and control of the pedal. The use of the cradle pedal also provides a great deal of freedom because only a small portion of the foot actually maintains actuating contact with any part of the pedal assembly. Further, the use of the cradle pedal design minimizes the pedal mass which needs to be moved. Thus, less pedal weight does the same work, thereby providing a lighter, more efficient pedal.

The use of the cradle pedal provides a pedal assembly which enables a drummer to play with greater accuracy at fast speeds, at slow speeds or at any desired intermediate speed. In addition, the use of the cradle pedal provides greater comfort to the drummer because his foot does not have to conform to a plane which rests at an angle with the floor as is the case with the elongate pedals of the prior art. The foot of the drummer rests in the cradle pedal where equilibrium is achieved when considering the position of the foot and the force being used. The drummer does not have to position his heel on the pedal as has been the case with the prior art pedals. The drummer who tends to play with his heel in the air will be delighted when playing mere straight beats one after the other in quick succession with greater ease than is provided by standard elongate pedals.

SUMMARY

In summary, a bass drum pedal assembly is provided for selectively actuating a drum beater assembly which comprises a floor engaging support base adapted for selective operative engagement to an adjacent drum beater assembly.

A cradle pedal support frame is pivotally mounted on the support base. The cradle pedal support frame is in substantially movable register with and above said support base. The pedal support frame is adapted at the forward free end thereof to operatively engage an actuator strap of an adjacent drum beater assembly. A foot engaging cradle pedal assembly is transversely freely mounted on the cradle pedal support frame. The cradle pedal assembly is swivellably freely mounted on the support frame so as to selectively engage the ball of a drummer's foot in self-adjusting contact therewith. The cradle support frame is adapted to actuate a drum beater assembly when connected to the actuator strap thereof in response to selective foot pressure selectively exerted upon the cradle pedal assembly.

In one embodiment of the bass drum pedal assembly, the cradle pedal assembly comprises a pair of transversely oriented parallel spaced apart flexible straps freely suspended from the cradle pedal support frame.

In another embodiment of the base drum pedal assembly, the cradle pedal assembly comprises a single transversely oriented flexible strap freely suspended from the cradle pedal support frame.

Longitudinal adjustment means are provided in association with the cradle pedal assembly and the cradle pedal support frame so as to provide for selective longitudinal adjustment of the cradle pedal assembly relative to the cradle pedal support frame. Vertical adjustment means are provided in association with the cradle pedal assembly and the cradle pedal support frame so as to provide for selective vertical adjustment of the cradle pedal assembly relative to the cradle pedal support frame.

Various other modifications of the invention may be made without departing from the principle thereof. Each of the modifications is to be considered as included in the hereinafter appended claims, unless these claims by their language expressly provide otherwise.

I claim:

1. In a bass drum pedal assembly for selectively actuating a drum beater assembly comprising:

a floor engaging support base adapted for selective operative engagement to an adjacent drum beater assembly;

a cradle pedal support frame pivotally mounted on said support base, said cradle pedal support frame being in substantially mov-able register with and above said support base, said pedal support frame adapted at the forward free end thereof to operatively engage an actuator strap of an adjacent drum beater assembly; and a foot engaging cradle pedal assembly transversely freely mounted on said cradle pedal support frame, said cradle pedal assembly swivellably freely mounted on said support frame so as to selectively engage the ball of a drummer's foot in self-adjusting contact therewith, said cradle support frame adapted to actuate a drum beater assembly when connected to the actuator strap thereof in response to selective foot pressure selectively exerted upon said cradle pedal assembly.

2. In the bass drum pedal assembly of claim 1 whereby the cradle pedal assembly comprises a pair of transversely oriented parallel spaced apart flexible straps freely suspended from said cradle pedal support frame.

3. In the bass drum pedal assembly of claim 1 whereby the cradle pedal assembly comprises a single transversely oriented flexible strap freely suspended from said cradle pedal support frame.

4. In the bass drum pedal assembly of claim 1 whereby longitudinal adjustment means are provided in association with said cradle pedal assembly and said cradle pedal support frame so as to provide for selective longitudinal adjustment of said cradle pedal assembly relative to said cradle pedal support frame.

5. In the bass drum pedal assembly of claim 1 whereby vertical adjustment means are provided in association with said cradle pedal assembly and said cradle pedal support frame so as to provide for selective vertical adjustment of said cradle pedal assembly relative to said cradle pedal support frame.

* * * * *